United States Patent [19]

Baldus et al.

[11] Patent Number: 4,862,619

[45] Date of Patent: Sep. 5, 1989

[54] MAGAZINE ADAPTER

[75] Inventors: Thomas E. Baldus, Charlotte; John M. Roy, Sheridan, both of Mich.

[73] Assignee: Precision Gun Specialties, Inc., Sheridan, Mich.

[21] Appl. No.: 235,537

[22] Filed: Aug. 24, 1988

[51] Int. Cl.[4] ..... F41C 25/00

[52] U.S. Cl. ..... 42/7

[58] Field of Search ..... 42/7, 50, 71.02

[56] References Cited

U.S. PATENT DOCUMENTS

| | | | |
|---|---|---|---|
| 1,015,490 | 1/1912 | Harrington | 42/7 |
| 3,377,732 | 4/1968 | Bivens | 42/50 |
| 4,343,107 | 8/1982 | Kaltenegger | 42/7 |
| 4,397,109 | 8/1983 | Pachmayr et al. | 42/50 |
| 4,495,720 | 1/1985 | Bross | 42/7 |
| 4,514,922 | 5/1985 | Farrar et al. | 42/7 |
| 4,592,160 | 6/1986 | Bross | 42/7 |

*Primary Examiner*—Charles T. Jordan

*Attorney, Agent, or Firm*—Miller, Morriss and Pappas

[57] ABSTRACT

A magazine adapter comprising a one piece cast or molded magazine encircling element for use with extended magazines for firearms and including lock means to secure the magazine adapter to the magazine by utilization of the existing floor plate of the sliding type. The adapter is externally faired to the contour of the butt and grip of the firearm so that the adapter, in use, appears to be an extension of the butt and contoured to the butt configuration.

3 Claims, 2 Drawing Sheets

MAGAZINE ADAPTER

The present invention relates to a magazine adapter principally for use with automatic firearms such as pistols and comprising an attachment to the end of an extended magazine and in such a manner as to utilize the floor plate and follower spring of the magazine and to form a trim or stop encirclement which fairs to the butt contour of the firearm and secures the magazine against wobble while providing a butt plate or grip locked into position by the floor plate and which conforms to the original butt contours of the firearm as extended by the extension magazine.

Extension magazines for firearms are relatively well known as for example in Harrington U.S. Pat. No. 1,015,490 in which an extended magazine is supplied with a supplemental stock, the stock being hollow to accomodate additional cartridges or to jacket an extended magazine. Catches and releases were provided converting the stock extension to the regular stock. More recently Kaltenegger U.S. Pat. No. 4,343,107, is directed to a contour providing sleeve which supplies a contoured front bead but which slides over the extended magazine against the extended floor plate of the magazine and rests at the top partially against the base of the butt of the pistol. In that work, the object in Kaltenegger is to modify the extended butt contour and to provide a finger support at a lower end of the magazine.

As firearm manufacturers offer extended magazines for use in firearms having a non-extended magazine, the problem of adapting the optional magazine to the firearms has been important. As will be seen, the structure of the present invention is locked onto the extended magazine by the existing floor plate of the magazine so as to restrict any movement of the adapter. The adapter, upon insertion of the magazine into the firearm, is faired against the butt of the firearm and becomes an extension of the butt and inseparable from the magazine except by removal of the floor plate. Such attachment provides a precision fit and prevents misalignment of the extended magazine in use and provides a comfortable finished "feel" to the firearm in use. The extended magazine equipped with the present adapter is firm, conveying the "feel" of a firearm designed for the extended magazine. The replacement of a regular (unextended) magazine with an extended magazine is achieved simply under field contitions. Accordingly, the present invention has as its principal object a precision made resin or plastic sleeve insertable over the lower end of an extended magazine and locked thereto against removal by the floor plate of the magazine.

Another object is to provide an adapter for extended magazines which is faired to conform to the original contours of the firearm butt.

Other objects including integrity of the magazine adapter and the recessing to achieve precision fit to the butt will be appreciated as the description proceeds.

IN THE DRAWINGS:

FIG. 1 is a side elevation view of a firearm or pistol of the removeable magazine type shown in phantom line with an extended magazine and in which the magazine adapter of the present invention is shown as a single integral element beneath the butt in full line and securely connected to the magazine by the floor plate.

FIG. 2 is an exploded side elevation view of a typical extended magazine and showing the removal of the floor plate from the magazine prior to attachment of the magazine adapter of the present invention and the magazine adapter is shown in full section with lockably reinserted floor plate registry firmly against the ledge in the magazine adapter, secured in place by the rolled edges of the base of the magazine and extending to provide forward bearing against the front of the magazine adapter.

GENERAL DESCRIPTION

Figure 1:
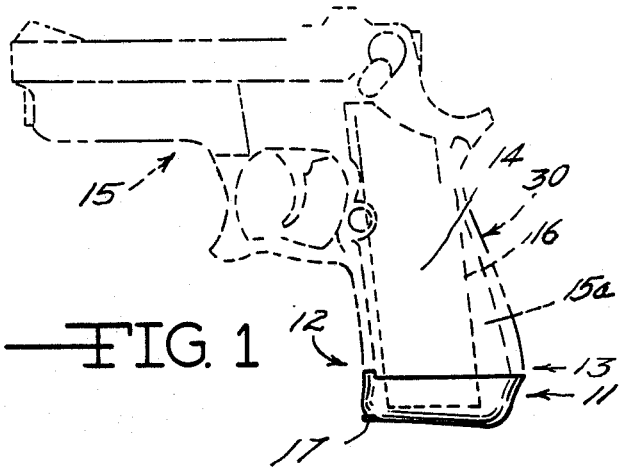

In general the present invention is embodied in a one piece precision cast resin magazine adapter designed for securing to an extension magazine by means of the floor plate so that a firm grip as between adapter and extension magazine is established. Then, the extension of the magazine adapter is faired or contoured to meet the regular contours of the butt of the particular pistol or firearm into which the magazine is inserted. The present structure is designed for use with extension magazines having a slide type floor plate detentably secured against removal by the side tracks formed by the rolled flanking edges of the magazine and which plate serves as a retainer then, against the thrust of a follower spring. Intermediate the follower spring and floor plate is a spring retainer and guide plate which serves as part of the detent means and which positions the spring while guiding the entry of the floor plate under and between the track formed by the rolled bottom edges of the magazine. The extension magazine is a cartridge receptacle and the cartridges are loaded from the top of the magazine where the cartridge follower cradles and delivers the cartridges, one at a time, to the receiver mechanism of the weapon or pistol. The extended magazines are longer than the regular magazine and when placed in a weapon designed for a regular or standard length magazine the extended magazine protrudes from the base of the butt and inset from the front, back and sides of the regular butt. The present invention serves as a filler for that void and provides a precision steadying means as the extended magazine is pressed into the butt and is snapped detentably into the firearm. The exterior design of the magazine adapter is a simple extension of the natural contour of the weapon and blends the extension magazine to the weapon. In this manner the handling of the weapon is greatly facilitated and a smoothly contoured butt provides extended utility, better stability against shock and drag-contact and better ability to deliver fire power with released comfort and consequent accuracy. The interior of the cast and cured resin magazine adapter receives the magazine base in a sliding precision fit after removal of the floor plate. A ledge serving as a stop engages the rear base of the magazine. The magazine base is thus positioned at a slight angle in respect to the relatively flat bottom profile of the magazine adapter and with the rolled edges or guides of the magazine extending into and through the cavity through the base of the adapter to rest against a stop or ledge. The floor plate may then be slid back into the magazine and it then rests on the upper surface of the ledge against the rear wall of the magazine and is detentably attached to the spring plate under the pressure of the follower spring and the front or nose extension of the follower plate then rests against the front portion of the magazine adapter. The magazine adapter rises, then, to fairing contact with the face of the front pistol grip. The rear portion of the magazine adapter fairs smoothly to the rear surface of the pistol grip and becomes an extension thereof when the extended magazine of the present invention is shoved into the butt of the pistol.

SPECIFIC DESCRIPTION

Referring to the drawings and first to FIG. 1, the magazine adapter 11 is shown and is faired. smoothly into the lower front and rear contours 12, 13 and sides 14 of the weapon or pistol 15 at the grip portion 15(*a*). By reference to FIG. 1 the terms "front" and "rear" herein are related to the firearm using these devices so that "front" is relative to the barrel end of the firearm 15 and "rear" to the handle end of the firearm "15" unless otherwise clearly indicated. This relativity of direction also applies with regard to "upper" and "lower" where "upper" relates to the firearm orientation at the barrel and "lower" to the firearm orientation at the butt or grip end. The extension adapter 11 encases the lower end of the extended magazine 16 as will be seen. The adapter 11 is locked to the magazine 16 by means of the front entry sliding floor plate 17 and the floor plate 17 bears in one direction against the base of the adapter 11 and at a ledge in the adapter 11 acting as a stop to full passage of the magazine 16 through the adapter 11.

Figure 2:
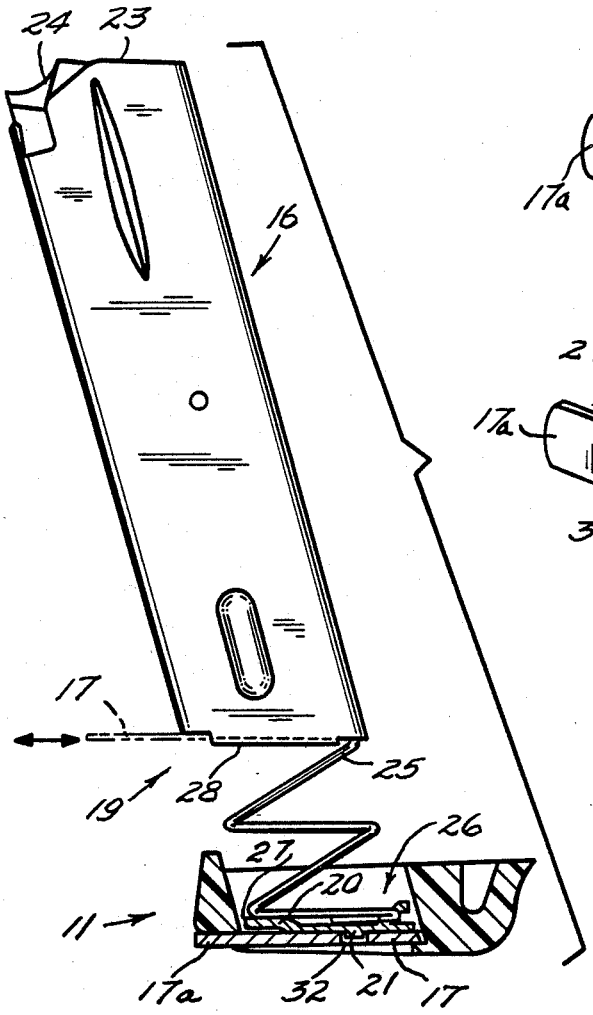

In FIG. 2 the relationship of the magazine adapter 11 to the magazine 16 is better understood. The magazine 16 includes a floor plate 17 which slidably (and as we will see, detentably) closes the bottom or base 19 of the magazine 16. At the upper end 23 of the magazine 16 a cartridge follower 24 is positioned and which is contoured to press cartridges (not shown) consecutively out of the upper end 23 and into the cartridge receiver section (not shown) of the pistol or weapon 15. The follower 24 thrusts against consecutively inserted cartridges and the thrust of the compression spring 25 against the follower and against the receiver plate 20 and floor plate 17. The same stored or compressed energy pressing cartridges upwardly in the magazine reacts against the thrust receiver plate or guide 20 and detentably secures the floor plate 17 in position against chance removal. The detent is overcome by depressing the spring 25 through the floor plate 17 by pressing upwardly against the dimple 21 in the thrust receiver plate or guide 20. This allows the floor plate 17 to be slid forwardly in the roll guide or tracks 28 and out of its stop relation whereupon the extension magazine adapter 11 is freed from connection to the magazine and its faired relation to the firearm 15 and the butt 30 or base of the grip 15*a*.

Upon removal of the floor plate 17 from the base 19 of the magazine 16 the obstruction of the nose portion 17*a* extending from the floor plate 17 prepares the magazine 16, follower 24, spring 25 and receiver plate 20 held within the encasement of the walls of the magazine 16 for insertion of the magazine 16 into the fitted cavity 26 of the adapter 11. The slight jog 27 in the thrust receiver plate 20 assists in reinsertion of the floor plate 17 sliding against the guide roll slides 28 in the base 19 of the magazine. As insertion progresses the floor plate 17 reengages detentably with the spring loaded receiver plate 20 and the dimple 21 and then rests with the magazine on the ledge 29 (now visible) in the rear of the cavity 26 in the adapter 11. It will be appreciated that the slightly askew relationship between the bottom line of the adapter 11 is to position the floor plate 17 in its identical relation as in a non-extended magazine and taking the front lower terminal position in relation to the butt 30 and grip 15*a*.

Figure 3:
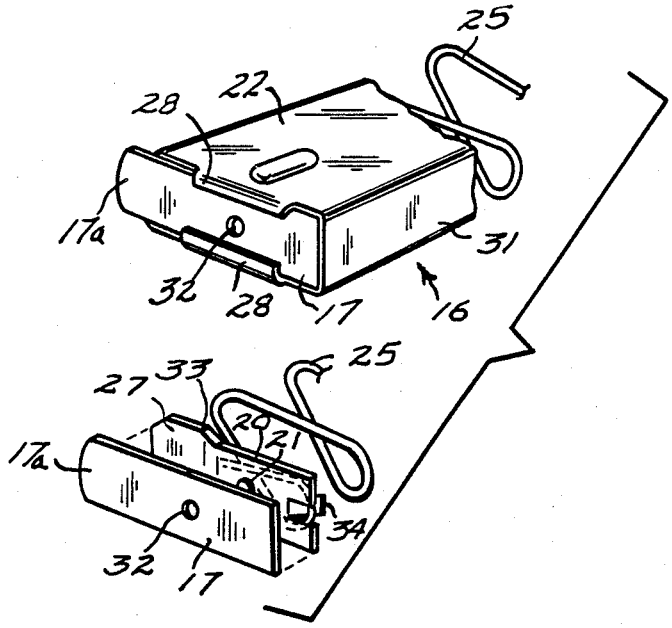
FIG. 3 is an exploded perspective view of the base of the extended magazine and illustrating the simple manner of dissassembly on removal of the floor plate. The floor plate extends forward of the magazine to mate with the butt contour of the pistol or firearm.

In FIG. 3 the extended magazine 16 is better understood in respect to the usual floor plate 17, the nose portion 17*a* of the floor plate 17 extending forwardly of the body 22 of the magazine 16. The slider rolled edge guides 28 allow frontal entry of the floor plate 17 until closing of plate 17 against the rear wall 31 of the body 22. The floor plate 17 is held against the rolled edge guides 28 as will be seen by the force of the follower spring 25 acting against the thrust receiving plate 20. The dimple 21 depends from the bottom of the thrust receiving plate 20, as shown, for detenting entry to the opening 32 of the floor plate 17 when the floor plate 17 is in proper and fully inserted position. The thrust receiving plate 20 includes a slight ramping 33 facilitating entry of the floor plate 17. The tab 34 located at the rear end of the thrust plate 20 assists in the orientation of the spring 25 assuring reasonably even guiding thrust of spring force against the plate 20 in assurance of proper detenting and thrust against the floor plate 17. At the other and upper end 23 of the magazine 16 the spring 25 thrusts against the cartridge follower 24 and the follower 24 is restrained by the upper edges of the magazine 16 from escaping upwardly from the magazine 16.

Figure 5:
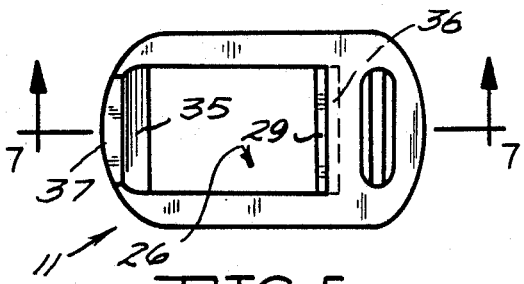
FIG. 5 is a top plan view of the magazine adapter seen in FIG. 4.
Figure 4:
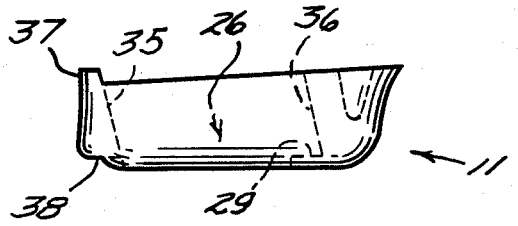
FIG. 4 is a side elevation view of the magazine adapter of the present invention and in phantom line indicating the internal recessing of the molded resin or plastic adapter.

In FIG. 4, divorced from the magazine 16 and firearm or pistol 15, the simplicity of the molded plastic or resin magazine adapter 11 is seen. In FIG. 5 the ledge 29 and central magazine receiving cavity 26 are better seen and the sloping entry walls 35 (front) and 36 (rear) are understood conforming closely to the cross sectional configuration of the magazine 16 (not shown) and upon insertion of the magazine 16 to the cavity 26 is blocked by engagement with the ledge 29. Entry to the cavity by the magazine 16 cannot occur until the floor plate 17 is removed from the magazine.

Figure 6:
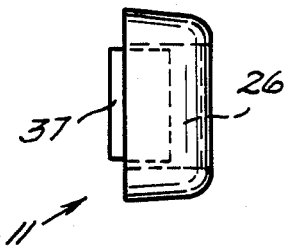
FIG. 6 is an end elevation view of the magazine adapter of FIG. 5 from the rear end of the adapter.

In FIG. 6 the adapter element 11 is seen from the rear illustrating the gently faired surfaces contoured to meet the grip portion 15*a* of the firearm 15 at the butt. The slightly raised front portion 37 of the adapter 11 is contoured to fair smoothly against the lower front countour of the firearm 15.

Figure 7:
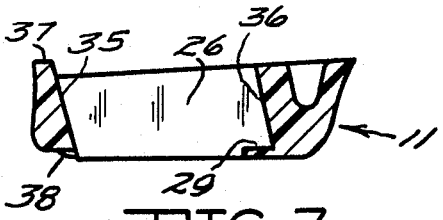
FIG. 7 is a full cross sectional elevation view on the line 7—7 of FIG. 5 and illustrating best the ledge upon which the floor plate of the magazine rests at the rear of the adapter.

The cross section of FIG. 7 best illustrates the interior relationship of the adapter 11 to mate with the butt 30 of a firearm 15 as if a continuation of its surfaces and in support of the magazine 16 securely to the firearm 15 in use and upon separation therefrom. It is retained by the magazine 16 in proper working relation so long as the floor plate 17 secures and locks it to the lower end of the magazine 16. The planar rest 38 for the nose portion 17*a* of the floor plate 17 is here integrated in the front configuration of the adapter 11. Thus the rest 38 forms an extension slot for the floor plate 17 so that the floor plate 17 can be slid into place and removed to lock and remove, respectively, the floor plate 17. In cooperation with the magazine 16 and the ledge 29, against which the magazine 16 fits, the floor plate 17, upon sliding entry in the described roll guides 28, lockably and neatly secures the adapter 11 ready for use with the magazine 16. When the magazine 16 is freed from the firearm 15 there is no change of position between the adapter 11 and the magazine 16 until the floor plate 17 is removed.

Figure 8:
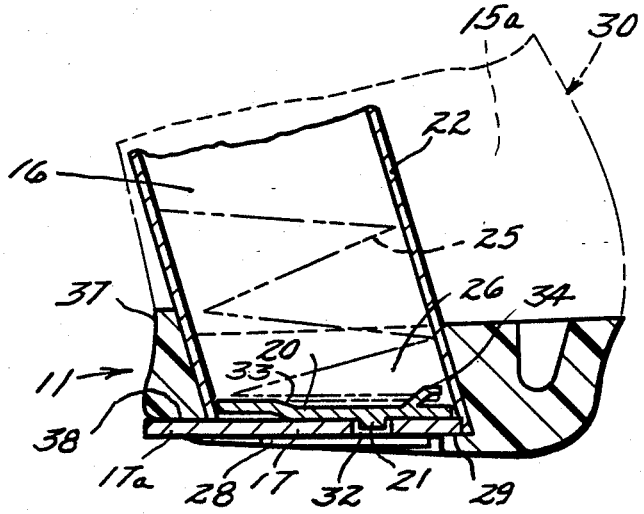
FIG. 8 is a full cross section elevation view through the lower portion of an extended magazine and through the magazine adapter as secured in the firearm butt. The firearm butt is shown in phantom line.

In FIG. 8 the locked relationship of adapter 11 to magazine 16 is best appreciated and the floor plate 17 is in tension with the magazine body 22 and the adapter 11 and is interlocked in positive location by the existing detenting elements of dimple 21 in the thrust receiving plate 20 pressed into the detent registering opening 32 in the floor plate 17. The floor plate nose 17*a* is secure on the rest 38 and the magazine 16 and rear edge of the floor plate 17 is firmly held against the ledge 29 and the interlock is achieved by the magazine itself, unmodified, and in secure retention of the floor plate 17 by the detenting elements and the guide roll slides 28. The only way to remove the adapter 11 is to remove the floor plate 17 upon depressing the dimple 21 and releasing the detent relationship between floor plate 17 and the thrust receiver plate 20. The adapter 11 is not needed except in situations where an extended magazine would otherwise project from the butt of the firearm.

The resin or plastic material preferred in the adapter 11 is a material which is tough and relatively rigid and sufficiently stable dimensionally to provide a good fit despite thermal and humidity fluctuations to be encountered in the storage and handling of firearms and magazines. Accordingly the finest casting material is material available under the trademark or tradename "Mylon." The "Mylon" material is glass fiber filled and after precision molding or casting the adapters 11 are boiled in water for about 4 hours to restore and preserve strength.

In testing, the adapters are repetetively secure in magazines of the type described and the firm grip is retained on the magazine with a precision faired fit to the butt of the firearm. In rapid fire no difficulties were encountered by interchanging magazines and the "clutch" between firearm and magazine is undisturbed. The loaded magazines with attached adapters 11 are easily carried on the person of officers or firearm users for instant usage as needed. The adapter 11 especially extends acceptance of the extended magazine concept and provides a desireable "feel" to those using the firearm thus equipped.

Having described our invention and a preferred embodiment thereof those familiar with pistols in military and law enforcement work particularly will instantly perceive its desireability and those ordinarily skilled in the art will perceive improvements, changes and modifications and such improvements, changes and modifications are intended to be included within the spirit of the present invention limited only by the scope of our appended claims.

We claim:

1. A magazine adapter for firearms using extended magazines and comprising:

a molded adapter in a single piece having a magazine receiving cavity therethrough and a ledge extending into said cavity providing a stop for said magazine; a planar rest in said adapter against which the nose piece of a floor plate in said magazine rests, said rest forming an extension slot from which said floor plate can be withdrawn from said magazine and said adapter; and the external side contours of said adapter faired to match the contouring of said firearm at the butt thereof.

2. In the magazine adapter for firearms as in claim 1 wherein said adpater is molded from a tough rigid and dimensionally stable filled plastic material.

3. In the magazine adapter for firearms of claim 1 in which said adapter is locked by said floor plate for selected insertion and removal from said magazine by detent means securing said floor plate in precision position, by slide elements on said magazine and by buttressing contact of said floor plate against said rest and said ledge of said adapter.

* * * * *